US005297482A

United States Patent [19]

Cleveland

[11] Patent Number: 5,297,482

[45] Date of Patent: Mar. 29, 1994

[54] RAIL THREADER

[76] Inventor: Robert K. Cleveland, 2625 Angel Dr., Stockton, Calif. 95209

[21] Appl. No.: 54,693

[22] Filed: Apr. 29, 1993

[51] Int. Cl.[5] ..... E01B 29/16

[52] U.S. Cl. ..... 104/7.2; 104/2; 104/7.1; 294/85; 294/103.1

[58] Field of Search ..... 104/2, 7.1, 7.2, 9, 104/307; 294/85, 103.1

[56] References Cited

U.S. PATENT DOCUMENTS

| | | | |
|---|---|---|---|
| 2,636,770 | 4/1953 | Cornwell | 294/103.1 |
| 2,936,192 | 5/1960 | Lince | 294/103.1 X |
| 3,199,462 | 8/1965 | Hooker | 104/2 |
| 3,240,160 | 4/1966 | Blix, Jr. et al. | 104/2 |
| 4,205,612 | 6/1980 | Luttig | 104/307 |
| 4,371,203 | 2/1983 | Munro | 294/85 X |

FOREIGN PATENT DOCUMENTS

| | | | |
|---|---|---|---|
| 1172978 | 4/1985 | U.S.S.R. | 104/2 |

*Primary Examiner*—Robert J. Oberleitner

*Assistant Examiner*—S. Joseph Morano

*Attorney, Agent, or Firm*—Zarley, McKee, Thomte Voorhees & Sease

[57] ABSTRACT

A rail threader comprising a top plate having side plates extending downwardly from the opposite sides thereof. A vertically disposed plate extends upwardly from the top plate and is adapted to serve as an abutment for the loose rail during the threading operation. The inside surface of one of the side plates has a pair of bars extending inwardly therefrom. When the rail threader has been positioned on a rail, a spacer bar is positioned between one side of the rail and the inside surface of the other side plate. A pair of bolts threadably extend through the other side plate and draw the bars on the first side plate into engagement with one side of the rail. The rail threader is securely held onto the rail by the engagement of the rods and the spacer bar which are urged into engagement with the opposite sides of the rail by the bolts. The loose rail may be threaded into the center of the tracks or threaded outwardly from the center of the tracks through the use of the rail threader.

12 Claims, 8 Drawing Sheets

RAIL THREADER

BACKGROUND OF THE INVENTION

1. Field of the Invention

This invention relates to a rail threader and more particularly to a device which may be mounted on a fixed rail to enable a loose rail to be threaded between the rails of the track or to be threaded outwardly from between the rails of the track.

2. Background Art

Spare or loose rails are frequently stored by the side of a railroad track, at predetermined spaced-apart locations, to enable a length of a fixed rail of the railroad track to be quickly replaced in the event of damage thereto. If a rail is damaged, and must be replaced, the section crew simple needs to go to the nearest location where a rail is stored rather than requiring a loose rail to be shipped from some central supply area.

The loose rails are normally positioned on a rail rest closely adjacent the side of the track at predetermined intervals. When it is desired to move the loose or spare rail to the location where it is to be used, the rail is normally first rolled towards the track by means of rail turning tools or the like. Once the loose rail has been rolled to a position closely adjacent the track, it is necessary to thread the loose rail into the center of the track so that the loose rail may be pulled to the location where it is needed.

The threading of the rail into the center of the track is extremely difficult and is sometimes dangerous. The rail simply cannot be pulled into the center of the track by a Hy-Railer or the like since the loose rail simply tends to slide on the rail and will not thread itself into the center of the track. In the past, to thread the rail into the track, the workers utilized lining bars and attempted to pry or roll the loose rail over one of the fixed rails. The loose rails are extremely heavy and frequently weigh in excess of 1,700 pounds which makes the lining bar method of threading the rail extremely difficult and sometimes dangerous.

SUMMARY OF THE INVENTION

A rail threader is described comprising a top plate having a pair of side plates secured thereto and extending downwardly therefrom in a spaced-apart relationship. The threader is inserted over the top of a fixed rail with the side plates being positioned on opposite sides of the rail. The inside surface of one of the side plates has elongated members secured thereto which extend toward the web of the fixed rail when the threader is mounted on a fixed rail. The other side plate of the threader is provided with a pair of threaded openings extending therethrough which receive bolts therein. A spacer bar is positioned between the inner ends of the bolt members and the web of the fixed rail. Tightening of the bolts causes the spacer bar to be brought into frictional engagement with the web of the rail. An upstanding plate is secured to the top surface of the top plate and is adapted to be in engaged by the loose rail as it is being threaded into the center of the track or threaded outwardly therefrom.

It is therefore a principal object of the invention to provide a rail threader.

Yet another object of the invention is to provide a rail threader which enables a single person to thread a loose rail into the center of the track or to thread a loose rail outwardly from the center of the track.

Yet another object of the invention is to provide a rail threader which is easily installed on rails of different sizes.

Still another object of the invention is to provide a rail threader which is safe to use.

Still another object of the invention is to provide a rail threader which may be quickly mounted on a rail or quickly removed therefrom.

These and other object of the subject invention will be apparent to those skilled in the art.

DESCRIPTION OF THE PREFERRED EMBODIMENT

Figure 1:
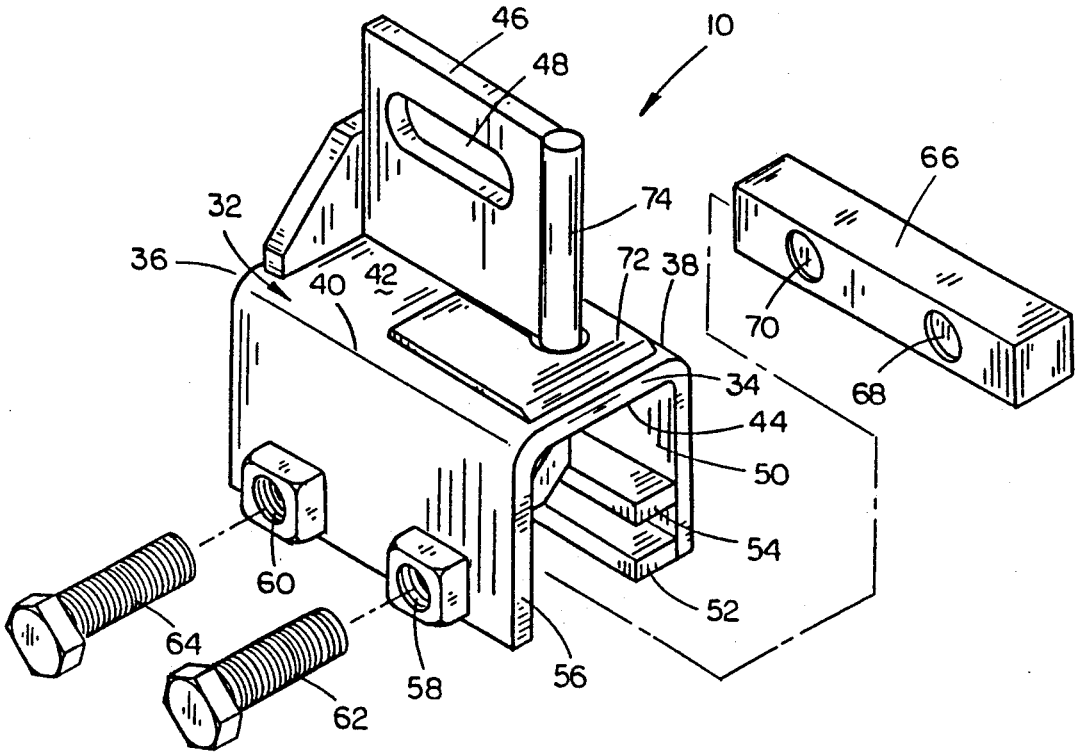
FIG. 1 is an exploded perspective view of the rail threader.

The rail threader of this invention is referred to generally by the reference numeral 10 while the reference numeral 12 refers to a conventional railroad track including fixed rails 14 and 16. For purposes of description, rail 14 will be described as including a base portion 16, web 18, and head or ball 20. The numeral 22 refers to a conventional Hy-Railer which is adapted to move along the rails 14 and 16 and which includes a boom 24 having a boom or winch cable 26 associated therewith. Vehicle 22 also includes a hitch 28 at the rearward end thereof. The numeral 30 refers to a loose or spare rail which is identical to the rails 14 and 16 and which may have various lengths such as 39 feet, etc. depending upon the particular railroad. Ordinarily, a loose or spare rail 30 is positioned along the side of the track 12 at every two miles or less, depending upon railroad policy. The spare or loose rails 30 are stored alongside the track, on a rail rest, in the event that one of the fixed rails becomes damaged or broken and it is necessary to replace a length of rail therein. Rail threader 10 includes a substantially horizontally disposed top plate 32 having a forward end 34, rearward end 36, opposite sides 38 and 40, top surface 42 and bottom surface 44. Plate 46 is welded to the upper surface 42 of plate 32 and extends upwardly therefrom as seen in the drawings. Plate 46 is provided with opening 48 formed therein to serve as a hand or finger hole to facilitate the carrying and positioning of the rail threader.

Figure 2:
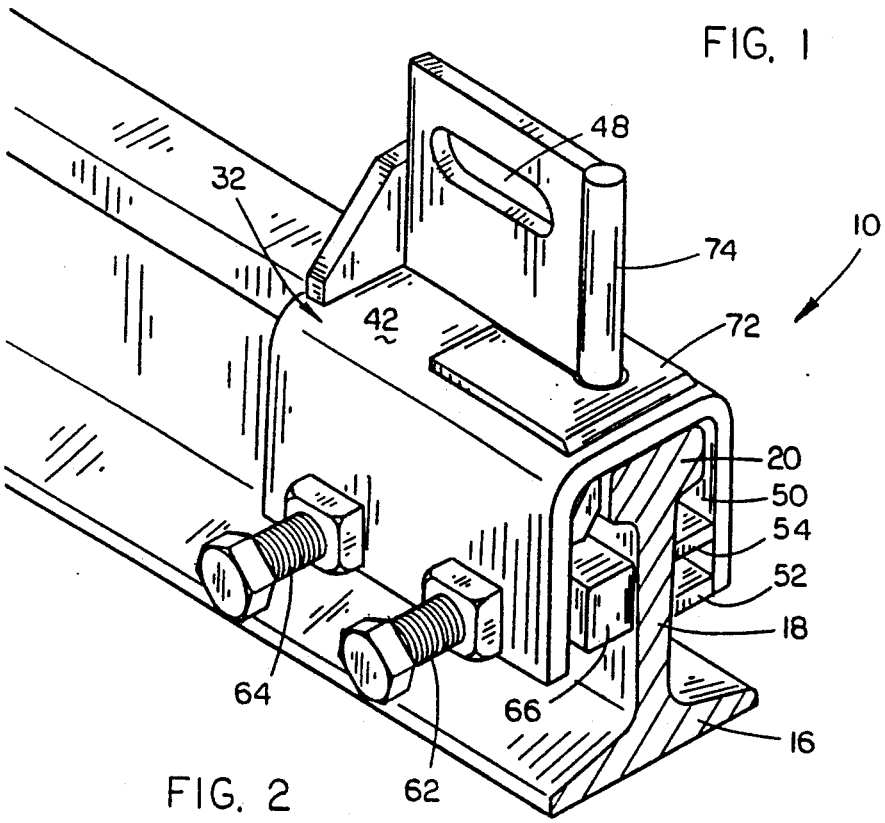
FIG. 2 is a perspective view of the rail threader mounted on a fixed rail.
Figure 4:
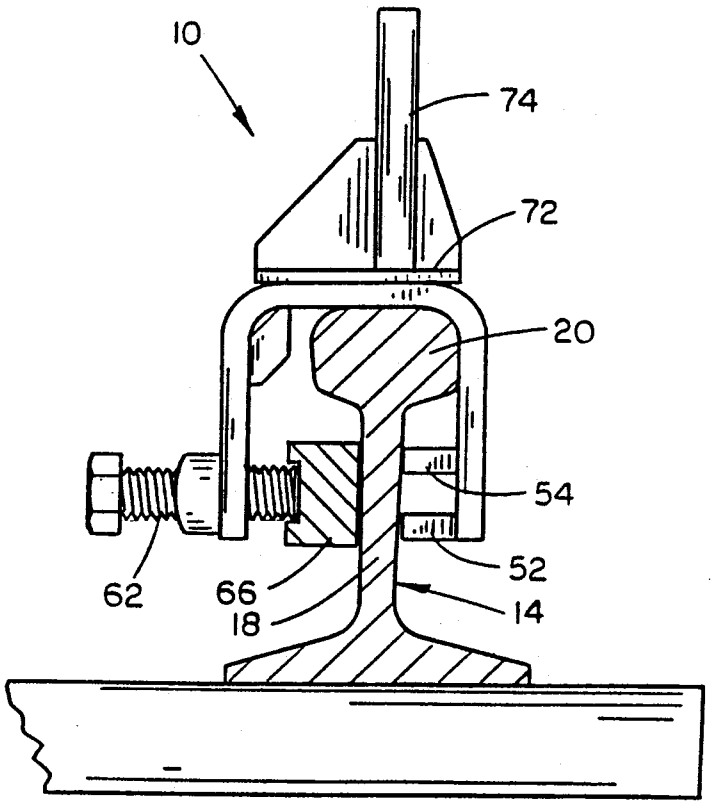
FIG. 4 is a sectional view illustrating the threader mounted on a fixed rail.

Side plate 50 extends downwardly from side 38 of plate 32 as seen in FIG. 1. A pair of elongated bars 52 and 54 are welded to the lower inside surface of side plate 50 as seen in FIGS. 1 and 2. Side plate 56 extends downwardly from top plate 42 at side 40 in a spaced-apart relationship with respect to side plate 50. Side plate 56 has a pair of threaded openings 58 and 60 formed therein which extend therethrough and which are adapted to threadably receive bolts 62 and 64 respectively. If desired, top plate 32 and the side plates 50 and 56 could be made of three-piece construction as opposed to the one-piece construction illustrated in the drawings.

The numeral 66 refers to a spacer bar having a length substantially equal to the length of the side plate 56. As seen in FIG. 1, bar 66 has a pair of indentations 68 and 70 formed wherein which are adapted to partially receive the inner ends of bolts 62 and 64 respectively.

Preferably, a wear-hardened surface 72 is provided on the upper surface 42 of top plate 32 to prevent undue wear of the rail threader. Further, a wear-hardened surface 74 is preferably positioned at the forward end of the plate 46 to prevent undue wear to the same.

Figure 3:
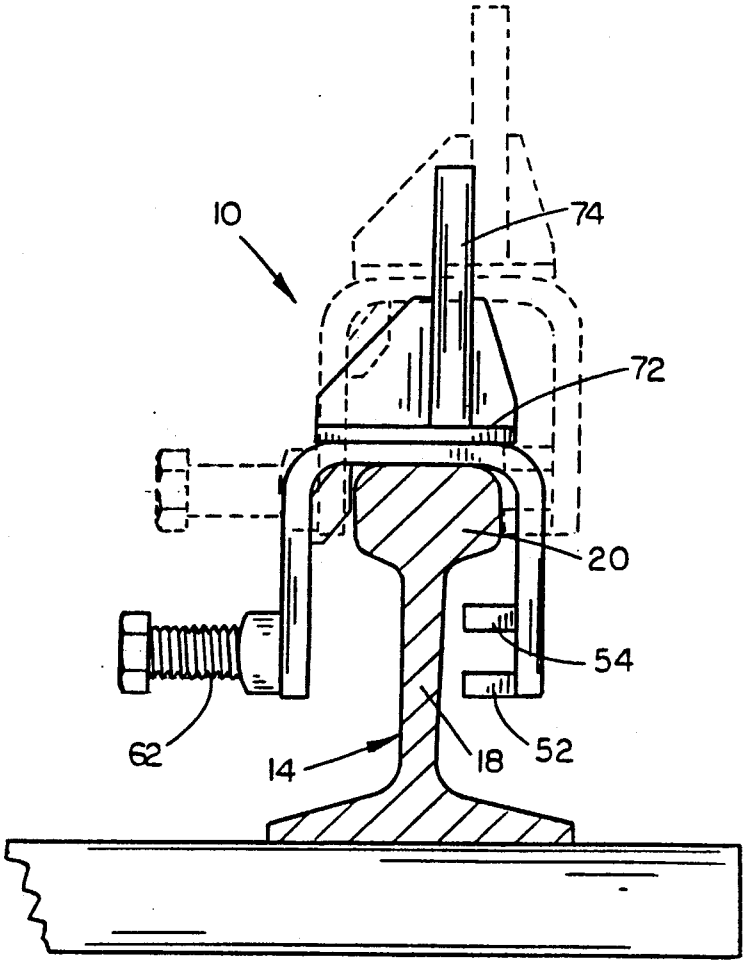
FIG. 3 is an end view of the threader initially positioned on a fixed rail with the broken lines indicating the manner in which the threader is positioned on the rail.

The rail threader 10 is mounted on the rail as follows. The bolts 62 and 64 are threadably moved outwardly with respect to the threaded openings 58 and 60 respectively so that the inner ends thereof do not protrude inwardly of the side plate 56. Threader 10 is then lowered onto the rail 14 as illustrated in FIG. 3. Spacer bar 66 is then positioned between web 18 of the rail 14 and the inner ends of the threaded openings so that the indentations 68 and 70 may partially receive the inner ends of the bolts 62 and 64. Bolts 62 and 64 are threadably moved inwardly in the threaded openings 58 and 60 and force the spacer bar 66 into engagement with the side of the web 18 of the rail 14. Continued tightening of the bolts 62 and 64 wedge the rail between the spacer bar 66 and the bars 52 and 54 to securely hold the threader 10 on the rail 14. The threader 10 is removed from the rail 14 in a manner reversed to that just described.

Figure 6:
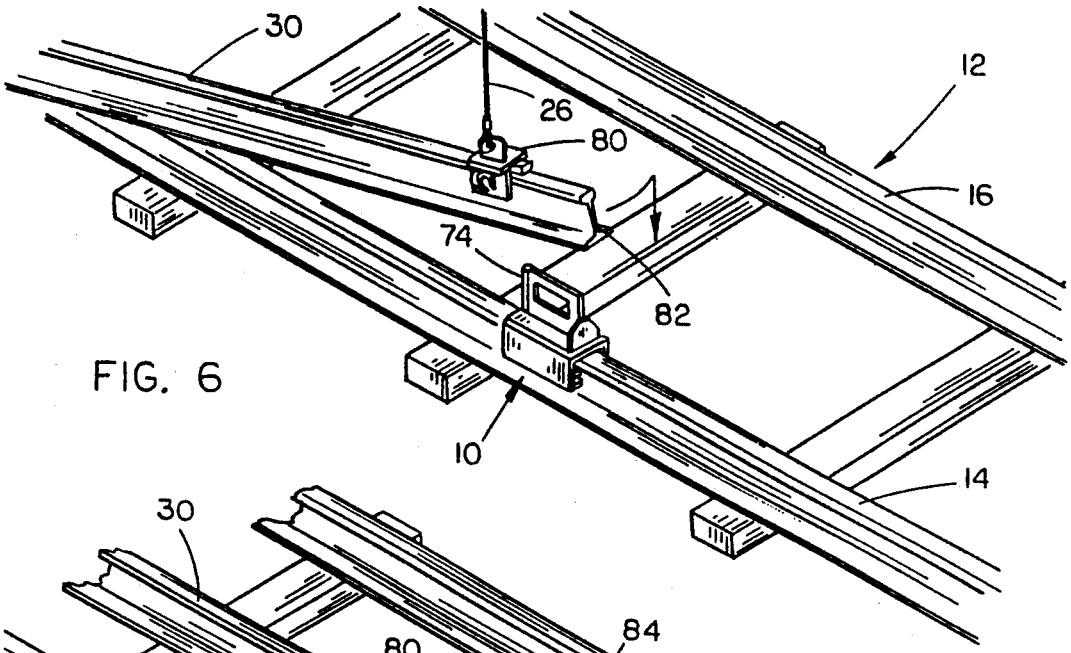
FIG. 6 is a perspective view illustrating the rail threader of this invention positioned on a fixed rail with the loose rail having a rail puller mounted thereon.
Figure 9:
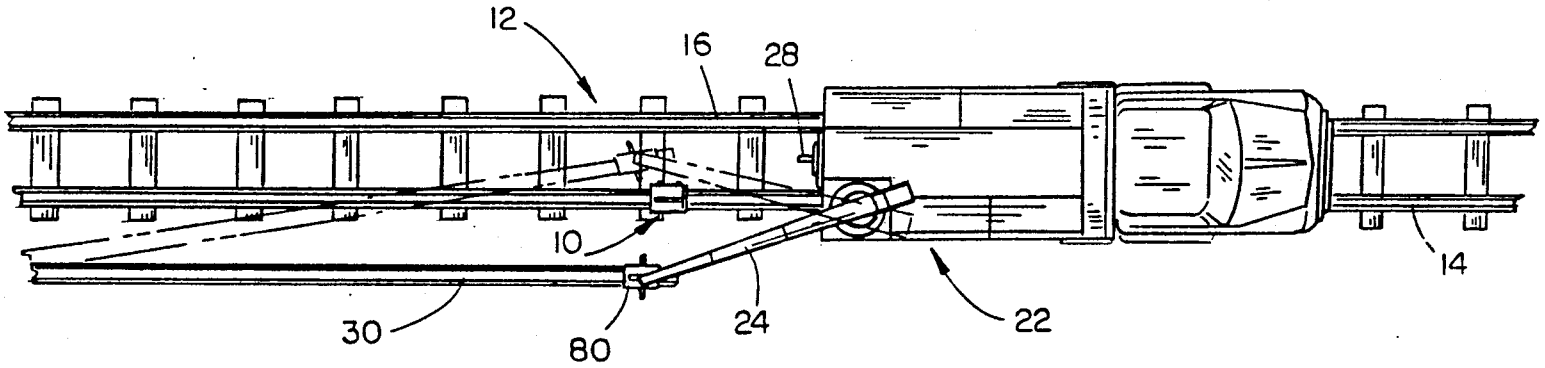
FIG. 9 is a top view illustrating the loose rail initially positioned outwardly of the fixed rails with the broken lines indicating the position to which the loose rail is initially placed to thread the rail into the center of the tracks.
Figure 10:
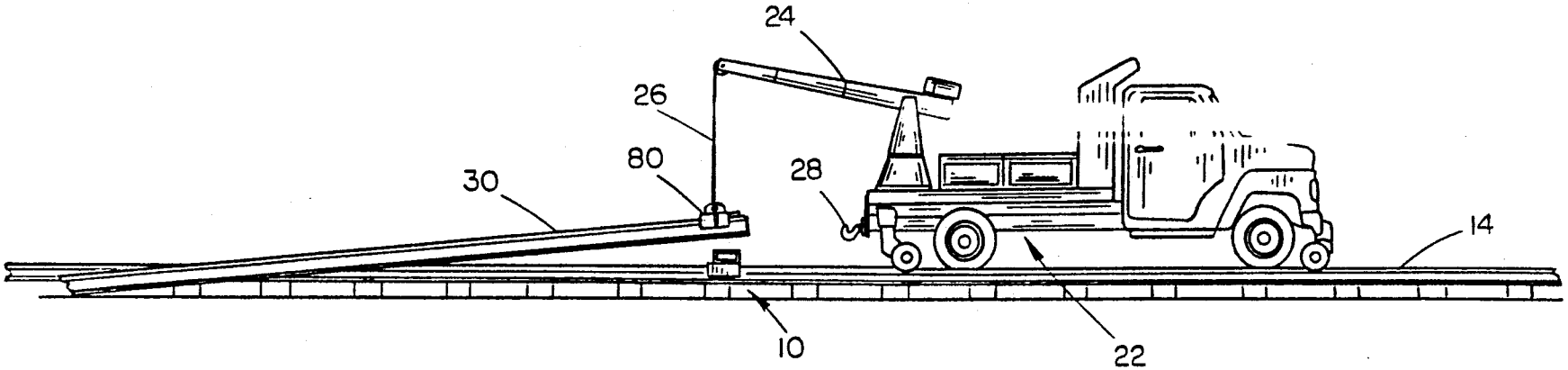
FIG. 10 is a side view illustrating one view of the loose rail being initially positioned inwardly of the rail threader to enable the rail to be threaded into the center of the track.

Assuming that the loose rail 30 has been rolled from its stored position to a position closely adjacent rail 14 as illustrated in FIG. 9, the first step is to secure a rail puller 80 on one end of the rail 30. It is preferred that the rail puller 80 have the structure disclosed in my co-pending application entitled RAIL PULLER filed concurrently herewith. The cable 26 of the Hy-Railer vehicle 22 is secured to the rail puller 80 and the end 82 of rail 30 is raised from the ground and swung inwardly from the solid line position of FIG. 9 to the dotted line position of FIG. 9. FIG. 6 illustrates the end of rail 30 being swung inwardly over rail 14 and the threader 10. When the end 82 of rail 30 has been positioned inwardly of threader 10 as illustrated by the broken line position of FIG. 9, the end 82 of rail 30 is lowered until the underside of the rail rests upon the rail 14 with the end 82 projecting beyond threader 10.

Figure 5:
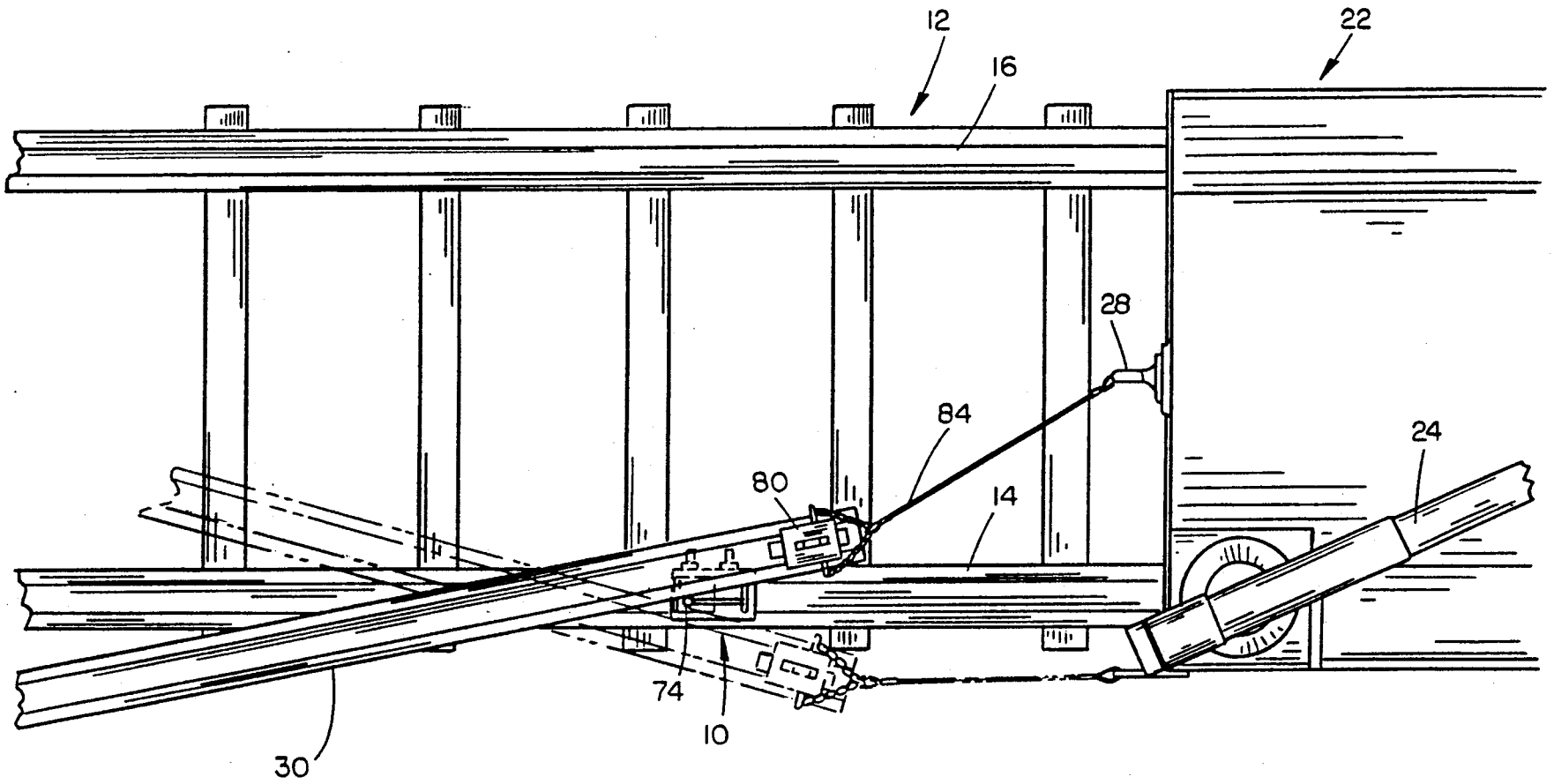
FIG. 5 is a top view illustrating the manner in which the loose rail is threaded into the center of the track with the broken lines illustrating the manner in which the loose rail is threaded from the center of the track.
Figure 11:
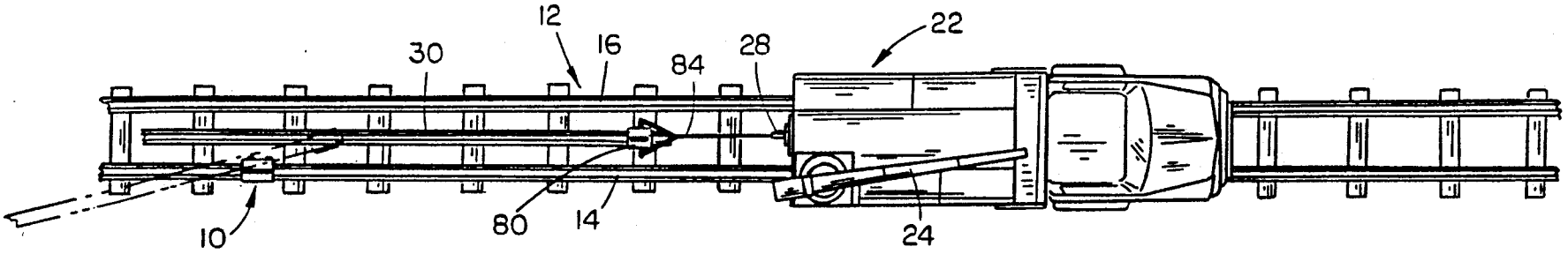
FIG. 11 is a top view illustrating the loose rail having been threaded into the center of the track with the broken lines indicating the initial position of the rail after one end was inserted inwardly of the rail threader.
Figure 12:
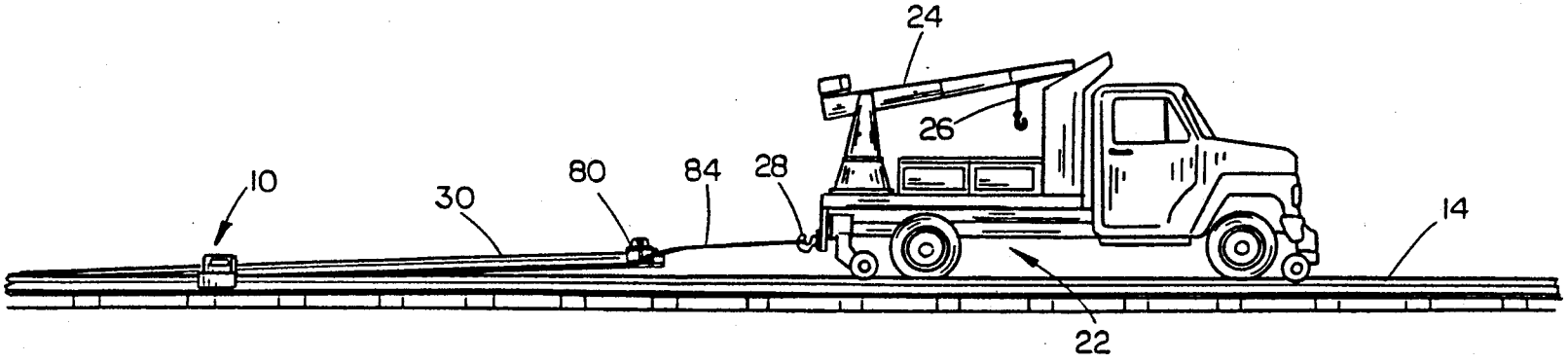
FIG. 12 is a side view illustrating the rail after it has been threaded into the center of the track.

The cable 26 is then disconnected from the puller 80 and a chain 84 is extended from the hitch 28 of vehicle 22 as seen in FIG. 5. The vehicle 22 is then driven away from the rail threader 10 in a direction which would be to the right as viewed in FIG. 11. Forward movement of the vehicle 22 causes the rail 30 to engage the forward end of the rail threader 10 as seen in FIG. 5. Continued forward movement of the vehicle 22 causes the rail 30 to be pulled or threaded into the center of the track as illustrated in FIGS. 11 and 12 due to the engagement of the rail with the threader 10.

Figure 7:
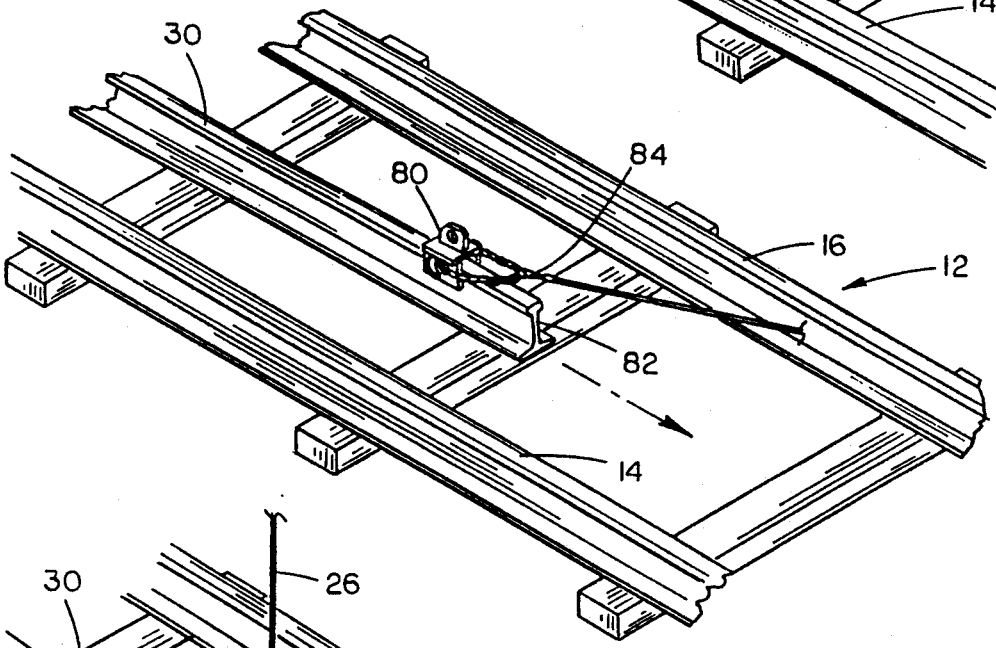
FIG. 7 is a perspective view similar to FIG. 6 which illustrates the rail being pulled along the length of the track.

The rail 30 is then pulled down the track between the rails 14 and 16 (FIG. 7) until the location is reached where the damaged rail is to be replaced. If there is sufficient time, before the passage of the next train, the rail 30 will be left between the fixed rails while the damaged rail is being removed. After the damaged rail has been removed and positioned just outwardly of its former location, the puller 80 is removed from the rail 30, if puller 80 has not been previously removed therefrom, with the rail 30 then being positioned in the position where the damaged rail was removed. After the rail 30 has been properly installed, the damaged rail will normally be pulled to a rail crossing or the like so that the damaged rail may be hauled to a scrap or dump yard. Normally, the rail puller 80 will be mounted on one end of the damaged rail and the threader 10 of this invention is positioned on the rail closest to the position of the damaged rail. The damaged rail is then threaded into the center of the track as previously described and pulled to the rail crossing or the like.

Figure 8:
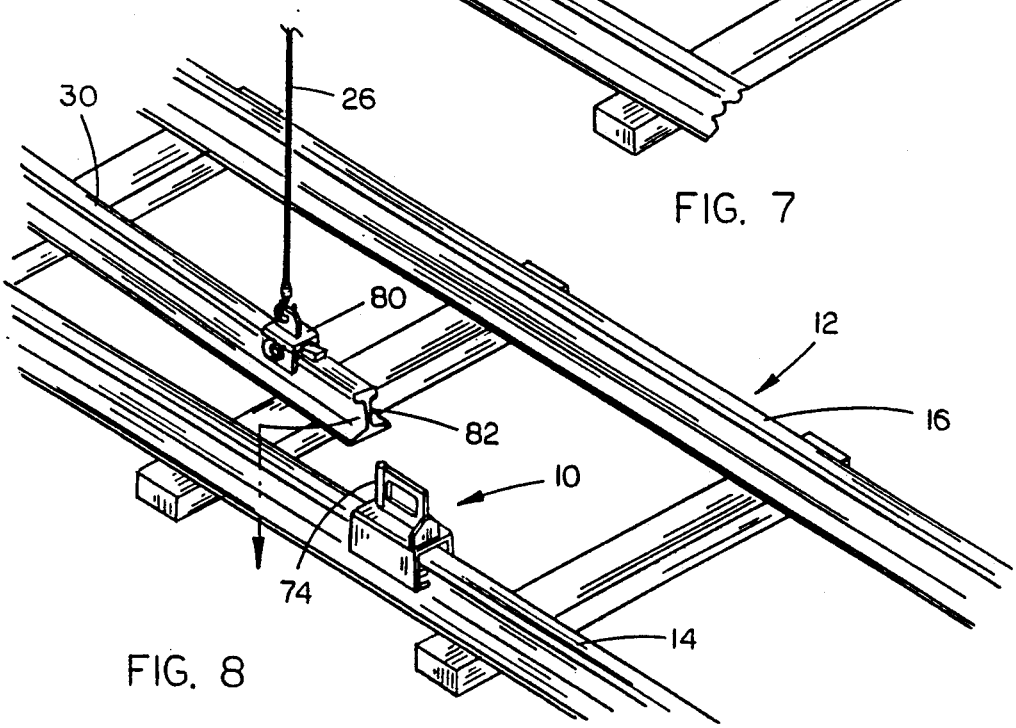
FIG. 8 is a view similar to FIGS. 6 and 7 except that the one end of the rail is being lifted outwardly of the threader to enable the loose rail to be threaded outwardly from the center of the track.

If there is not sufficient time to repair the damaged rail, after the loose rail 30 has been initially pulled to the location of the damaged rail, due to the fact that a train may be passing thereby shortly, the loose rail 30 could be initially threaded outwardly from the center of the track until such time as the train has passed. To accomplish the outward threading of the rail 30 from the center of the track, the rail threader 10 is again positioned on the rail 14 rearwardly of the forward end 82 of rail 30. The chain 84 would be disconnected from the vehicle hitch 28 and from the rail puller 80. Winch cable 26 is then hooked to the rail puller 80 with the winch being operated to raise the end 82 of the rail 30 above the upper end of rail threader 10. The end 82 of rail 30 is then swung outwardly of the rail threader 10, as viewed in FIG. 8, at which time the end 82 of the rail 30 is lowered until the rail rests upon the rail 14 with the end 82 of the rail 30 protruding beyond the rail threader 10.

After the rail 30 has been lowered into engagement with the rail 14 with the end 82 of the rail 30 protruding beyond rail threader 10, a chain is again hooked to the rail puller 80 and would normally be hooked to the right rear of the vehicle as illustrated by broken lines in FIG. 5. The vehicle 22 is then driven forwardly which causes the rail 30 to engage the forward end of the rail threader 10 with the continued forward movement of the vehicle 22 causing the entire length of the rail 30 to be threaded outwardly from the center of the track.

Figure 13:
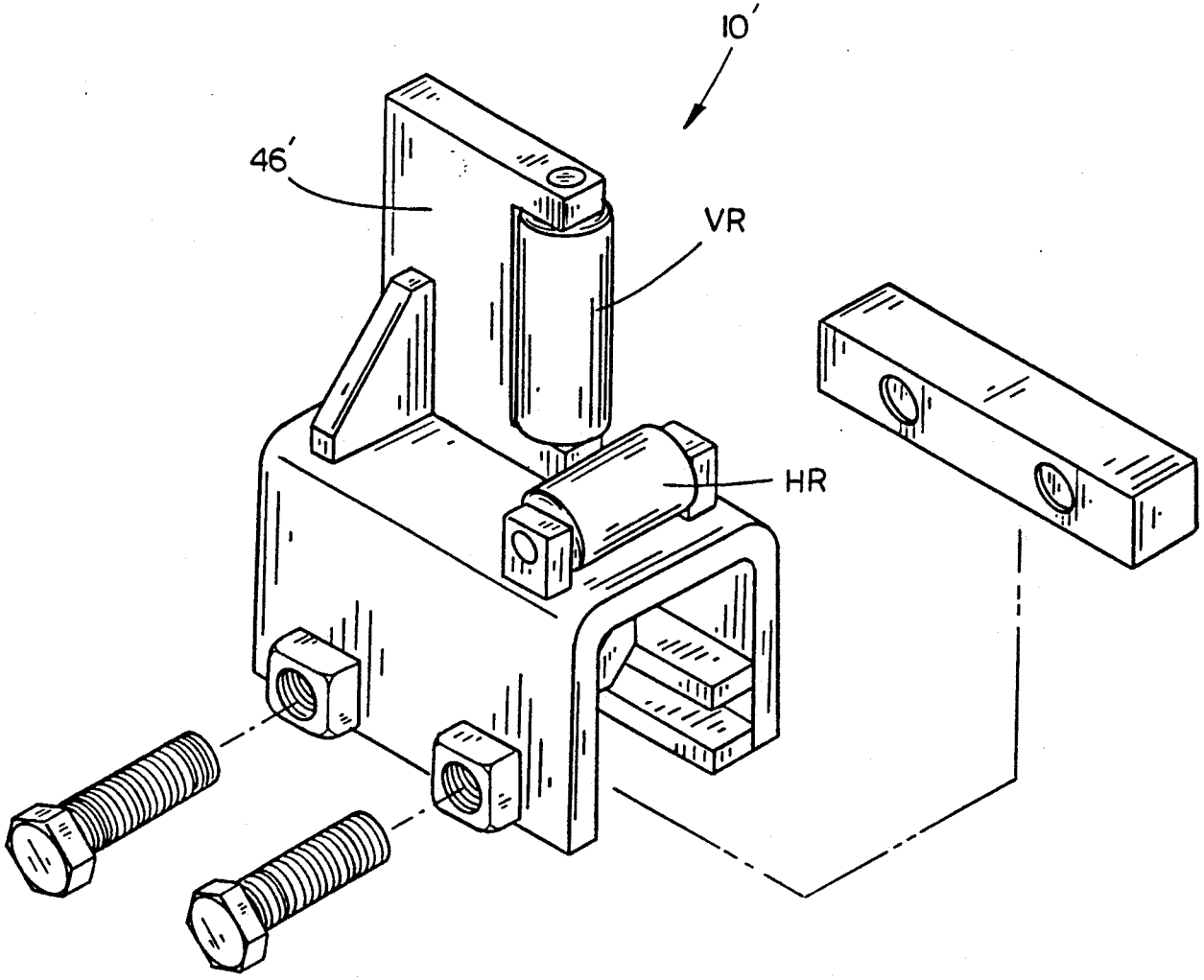
FIG. 13 is an exploded perspective view of a modified form of the rail threader.

FIG. 13 illustrates a modified form of the rail puller and is referred to generally by the reference numeral 10'. Rail threader 10' is identical to rail threader 10 except that a vertically disposed roller VR is rotatably mounted at the forward end of plate 46' instead of a wear-hardened surface. Threader 10' also includes a horizontally disposed roller HR rotatably mounted thereon which is substituted for the wear-hardened surface 72 on the threader. The vertically disposed roller VR and the horizontally disposed roller HR facilitate the movement of the rail with respect to the threader.

Figure 14:
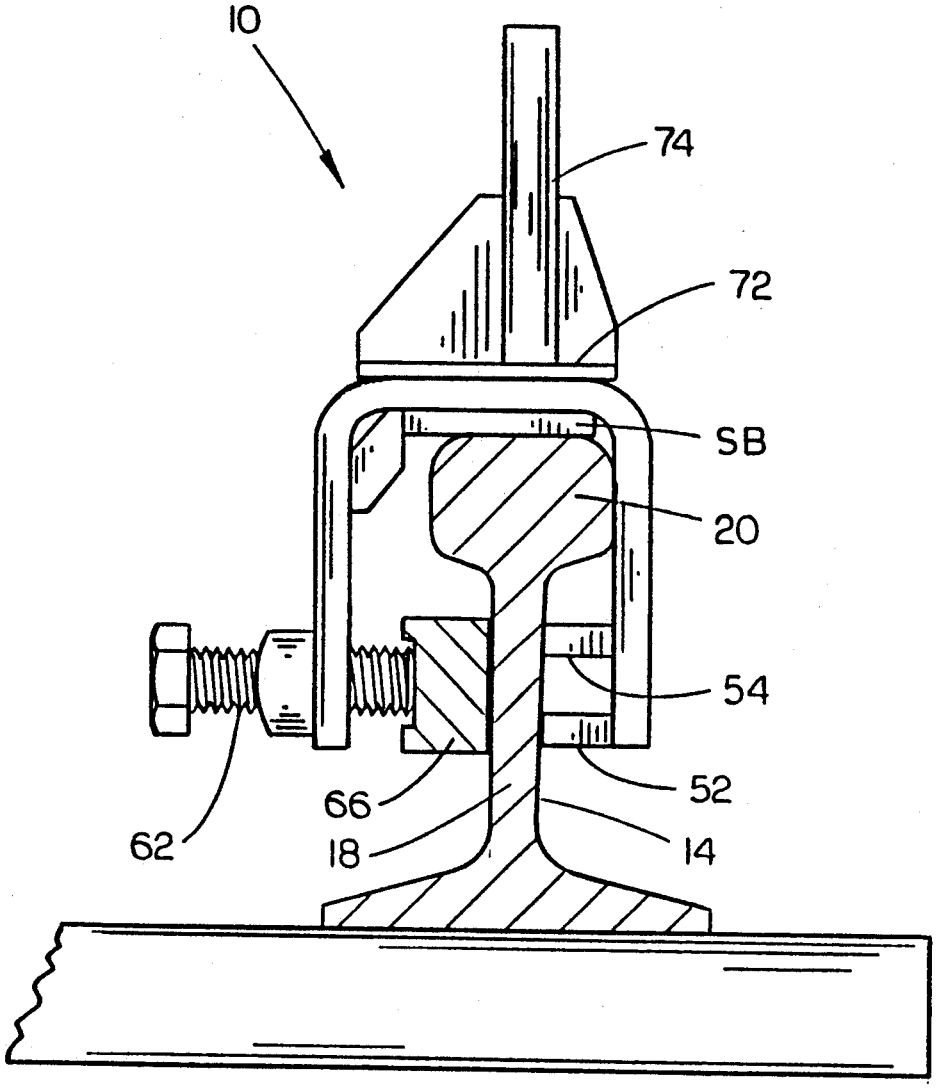
FIG. 14 is a view similar to FIG. 4 except that a spacer is utilized.

In some cases, when the threader is being used on small rails, it may be advantageous to utilize a small rectangular spacer block SB between the top of the fixed rail and the underside of top plate 42 as illustrated in FIG. 14.

Thus it can be seen that a novel rail threader has been provided which enables a loose or spare rail to be easily threaded into the center of the track or threaded outwardly therefrom in a rapid and safe fashion. A single person can thread the rail into the center of the track or thread the rail outwardly from the center of the track. Thus it can be seen that the invention accomplishes at least all of its stated objectives.

I claim:

1. A loose rail threader for mounting on a fixed rail of a railroad track having a base, a web portion extending upwardly therefrom, and a ball at the upper end thereof, comprising:

a top plate portion having opposite ends and opposite sides;

a first side plate portion at one side of said top plate portion and extending downwardly therefrom, said first side plate portion having inner and outer surfaces;

projection means on the inner surface of said first side plate portion extending laterally inwardly therefrom;

a second side plate portion at the other side of said top plate portion extending downwardly therefrom;

said side plate portions being sufficiently spaced to enable said top plate portion to be positioned on the rail ball with said side plate portions being positioned on opposite sides of said web portion;

a removable spacer member for positioning between said second side plate portion and one side of the web portion of the fixed rail;

said second side plate portion having at least one threaded opening formed therein;

a bolt member threadably mounted in said threaded opening for engagement with said spacer member for forcing said spacer member against the said one side of said web portion and for drawing said projection means into engagement with the other side of said web portion;

and rail abutment means extending upwardly from said top plate to enable a loose rail to be brought into abutting engagement therewith so that the loose rail is either threaded into the track or threaded outwardly therefrom.

2. The loose rail threader of claim 1 wherein a spacer is positioned between the upper end of the fixed rail and said top plate.

3. A loose rail threader for mounting on a fixed rail of a pair of spaced apart fixed rails, said fixed rail including a base portion, a web portion extending upwardly therefrom, and a bail on the upper end of said web portion, comprising:

a clamp means for removable attachment to said fixed rail;

a rail abutment means extending therewith upwardly from said damp means to enable the loose rail to be brought into moving abutting engagement therewith so that said loose rail is either threaded into the pair of fixed rails or threaded outwardly from therebetween, said clamp means comprising a horizontally disposed top member having opposite ends and opposite sides, a first side member extending downwardly from one side of said top member, a second side member extending downwardly from the other side of said top member, said first said member having means extending inwardly therefrom for engagement with one side of said web portion of said fixed rail, said second side member having at least one threaded opening extending therethrough, a spacer means for removably positioning between said second side member and the other side of said web portion of said fixed rail, and a bolt means threadably mounted in said threaded opening for forcing said spacer means into engagement with the other side of said web portion of said fixed rail.

4. The loose rail threader of claim 3 wherein said abutment means comprises an upstanding plate.

5. The loose rail threader of claim 3 wherein a wear surface is provided on said top plate.

6. The loose rail threader of claim 3 wherein said abutment means comprises an upstanding plate having opposite ends and wherein said upstanding plate has a wear surface provided at one end thereof.

7. The loose rail threaded of claim 6 wherein said top plate has a wear surface provided thereon at the lower end of said upstanding plate.

8. The loose rail threaded of claim 3 wherein said second side member has a pair of horizontally spaced apart threaded openings extending therethrough, said spacer means comprising an elongated bar having a length substantially equal to the length of said second side member.

9. The loose rail threaded of claim 8 wherein said bar has a pair of indentations formed therein for receiving the inner ends of the bolt means threadably extending through said threaded openings.

10. The loose rail threaded of claim 3 wherein a vertically disposed roller means is mounted on said rail abutment means.

11. The loose rail threaded of claim 3 wherein a horizontally disposed roller means is mounted on said rail abutment means.

12. The loose rail threaded of claim 3 wherein a horizontally disposed roller means is mounted on said rail abutment means and a vertically disposed roller means is mounted on said rail abutment means.

* * * * *